US005688750A

United States Patent [19]

Cooban et al.

[11] Patent Number: 5,688,750

[45] Date of Patent: Nov. 18, 1997

[54] BASE FLUID

[75] Inventors: Nigel Andrew John Cooban, Merseyside, Great Britain; Hendrik Leendert Rieffe, Gouda, Netherlands

[73] Assignee: Unichema Chemie B. V., Gouda, Netherlands

[21] Appl. No.: 556,933

[22] PCT Filed: May 11, 1994

[86] PCT No.: PCT/EP94/01634

§ 371 Date: Dec. 1, 1995

§ 102(e) Date: Dec. 1, 1995

[87] PCT Pub. No.: WO94/28093

PCT Pub. Date: Dec. 8, 1994

[30] Foreign Application Priority Data

Jun. 2, 1993 [EP] European Pat. Off. ..... 93201574

[51] Int. Cl.[6] ..... C10M 107/34; C10M 145/38

[52] U.S. Cl. ..... 508/497; 72/42; 560/198; 560/200; 560/224

[58] Field of Search ..... 508/465, 497; 560/198, 200, 224; 72/42

[56] References Cited

U.S. PATENT DOCUMENTS

| | | | |
|---|---|---|---|
| 2,570,037 | 10/1951 | Smith, Jr. | 508/497 |
| 2,755,251 | 7/1956 | Barker | 508/497 |
| 2,830,021 | 4/1958 | Smith | 508/496 |
| 3,492,232 | 1/1970 | Rosenberg . | |
| 3,551,335 | 12/1970 | Schwartz . | |
| 3,843,535 | 10/1974 | Denis et al. | 508/497 |
| 3,871,837 | 3/1975 | Bedague et al. | 508/465 |
| 3,912,642 | 10/1975 | Sturwold . | |
| 3,912,771 | 10/1975 | Kuhn . | |
| 4,172,802 | 10/1979 | Rieder . | |
| 4,359,393 | 11/1982 | Sturwold . | |

*Primary Examiner*—Jacqueline V. Howard
*Attorney, Agent, or Firm*—Cushman Darby & Cushman IP Group Pillsbury Madison & Sutro LLP

[57] ABSTRACT

A base fluid for metal working fluids comprises a stoichiometrically neutral salt of the partial esterification product having an acid number of 10–120, preferably 20–100 of polymerized fatty acids and a monohydric alkoxylated alcohol, selected from (a) straight or branched chain saturated monohydric $C_1$-$C_{24}$ alcohols, alkoxylated with 2–25 moles of $C_2$-$C_5$ alkylene oxide, (b) alkoxy poly(alkylene) glycol etherified with $C_1$-$C_4$ aliphatic monohydric alcohol and which is alkoxylated with 2–25 moles of $C_2$-$C_5$ alkylene oxide, (c) an aliphatic, straight or branched chain, saturated or unsaturated $C_1$-$C_{24}$ monohydric alcohol, and mixtures thereof, which partial ester is converted into a stoichiometrically neutral salt by neutralizing it by ammonium hydroxide, or an alkali metal hydroxide or an alkyl amine or an alkanol amine. Also the novel stoichiometrically neutral alkali metal and alkanol amine salts of the partial esters have been claimed.

17 Claims, No Drawings

BASE FLUID

This application claims benefit of international application PCT/EP94/01634 filed May 11, 1994.

The present invention relates to a base fluid for a metal working fluid, which comprises a salt of an esterification product. The present invention also relates to novel alkali metal and alkanol amine salts of specific partial esters.

By "metal working fluid" is understood throughout this specification and the attached claims fluids which are used in machining and working operations of in particular (but not exclusively) metals, such as turning, milling, drilling, grinding, punching, deep drawing and the like operations. These metal working fluids usually are in the form of water and oil emulsions.

Such metal working fluids have been disclosed in American Patent Specification U.S. Pat. No. 4,172,802 (Cincinnati Milacron Inc.) in which metal working fluid compositions have been described, comprising water and a carboxylic acid group terminated diester of dimerized or trimerized $C_8$-$C_{26}$ unsaturated fatty acids and a polyoxyalkylene diol having two terminal secondary alcohol groups, or the alkali metal salt or organic amine salt of said diester.

These compositions are said to have a high resistance to hydrolysis also upon prolonged storage, but the disadvantage of esters of this type is that due to the bifunctionality of the constituent acid and alcohol highly viscous products are obtained, and if salts of partial esters are formed, the viscosity increases even further as a result of this salt formation.

In U.S. Pat. No. 4,172,802 no examples of the formation of the partial esters or their salts have been given and also it has not been indicated what acid and/or hydroxyl numbers the esterification products exhibit.

It has now been found that salts of specific partial esters of polymerized unsaturated $C_{12}$-$C_{24}$ fatty acids with a monohydric alkoxylated alcohol are excellent base fluids for metal working fluids and can be used in effective amounts in conventional metal working fluids, which preferably are in the form of an oil and water emulsion, which may have a transparent or preferably a milky appearance. It has particularly been found that the oil and water emulsions comprising the salts of the specific partial esters according to the present invention after their use can easily be broken by a reduction of their pH value. In the subsequent waste water treatment lower C.O.D. values for the waste water are required and hence a more economic waste water treatment is possible.

Therefore, the present invention relates to a base fluid for metal working fluids comprising a salt of the esterification product obtained by partial esterification of:

(a) polymerized unsaturated $C_{12}$-$C_{24}$ fatty acid, selected from the group consisting of dimer acid, trimer acid, hydrogenated dimer acid, hydrogenated trimer acid, and mixtures thereof, and (b) a monohydric alkoxylated alcohol selected from the group consisting of:

(1) straight or branched chain, saturated monohydric alcohols having from 1 to 24 carbon atoms which are alkoxylated with from 2 to 25 moles of a $C_2$-$C_5$ alkylene oxide, (2) alkoxy polyalkylene glycols in which one of the two terminal hydroxyl groups is etherified with a $C_1$-$C_4$ aliphatic monohydric alcohol and which is alkoxylated with from 2 to 25 moles of a $C_2$-$C_5$ alkylene oxide, and mixtures of (1) and (2), and optionally (c) an aliphatic, straight or branched chain, saturated or unsaturated monohydric alcohol having from 1 to 24 carbon atoms, until a partial ester is obtained having an acid number of from 10 to 120, after which the said partial ester is:

(d) converted into a stoichiometrically neutral salt by means of a neutralizing agent, selected from the group consisting of ammonium hydroxide, the alkali metal hydroxides, the alkyl amines, the alkanol amines, and mixtures thereof.

The polymerized unsaturated $C_{12}$-$C_{24}$ fatty acids are selected from the group consisting of dimer acid (such as PRIPOL 1013, 1017 or 1022 (Trade Mark) ex Unichema Chemie BV, Gouda, The Netherlands), trimer acid, hydrogenated dimer acid (such as PRIPOL 1009 or 1025 (Trade Mark) ex Unichema Chemie BV, Gouda, The Netherlands), hydrogenated trimer acid and mixtures thereof. If need be the dimer and trimer acids may be distilled prior to or after their hydrogenation. The use of trimer acid (such as PRIPOL 1040 (Trade Mark) ex Unichema Chemie BY, Gouda, The Netherlands), is preferred.

The monohydric alkoxylated alcohol may be selected from the group consisting of:

(1) straight or branched chain saturated monohydric alcohols having from 1 to 24 carbon atoms, which are alkoxylated with from 2 to 25 moles, preferably from 6 to 12 moles of a $C_2$-$C_5$ alkylene oxide, such as ethylene oxide, propylene oxide, butylene oxide, and mixtures of these alkylene oxides. Preferably the average molecular weight is from 200 to 900. The monohydric alcohols may for example be methanol, isopropanol, octanol, decyl alcohol, iso-octyl alcohol and the like. Also mixtures of alcohols may be used, such as for example Synprol alcohol (a saturated synthetic primary alcohol mixture ex ICI PLC, UK, obtained by hydro-formylation of linear alpha-olefins and also Synprol 91 (a saturated synthetic primary alcohol mixture, ex ICI PLC, UK).

(2) alkoxy polyalkylene glycols in which one of the two terminal hydroxyl groups is "capped" or etherified with a $C_1$-$C_4$ aliphatic monohydric alcohol, such as methanol or butanol, and which comprises from 2 to 25 moles, preferably from 6 to 12 moles of a $C_2$-$C_5$ alkylene oxide, such as ethylene oxide, propylene oxide, butylene oxide and mixtures of these alkoxides. Preferably, the average molecular weight is from 200 to 900.

The aliphatic, straight or branched chain, saturated or unsaturated monohydric alcohol preferably has from 3 to 14 carbon atoms, such as isopropanol, 2-ethylhexanol and tridecylalcohol. The monohydric alcohol may be admixed with the monohydric alkoxylated alcohol, or the species mentioned under (b)(1) may only partially be alkoxylated, or the polymerized fatty acids may first be reacted with the monohydric alkoxylated alcohol and subsequently with the monohydric alcohol.

The polymerized fatty acid and the monohydric alkoxylated alcohol are reacted such that a partial ester is formed, having an acid number of from 10 to 120, preferably from 20 to 100.

The partial ester obtained is then converted into a stoichiometrically neutral salt by means of a neutralizing agent. The neutralizing agent is selected from the group consisting of ammonium hydroxide; the alkali metal hydroxides; the alkylamines, such as the alkyl primary amines, the alkyl secondary amines and the alkyl tertiary amines, preferably having from 6 to 8 carbon atoms in the alkyl group of the amine; the alkanol amines, such as the monoalkanol, dialkanol and trialkanol amines, in which the alkanol group preferably contains from 2 to 8 carbon atoms, and mixtures of these neutralizing agents. Examples are ethyl amine, isopropylamine, monoethanolamine, mono-isopropanolamine, triethanolamine, tri-isopropanolamine, 2-amino-2-methylpropanol-1 and the like. The salts are prepared thus that the neutralization of the available reactive carboxyl groups in the partial ester is complete or almost complete, the obtained salt being stoichiometrically neutral.

When used as a base fluid in a conventional metal working fluid the final salt can be used in an amount of from 1% by weight to 95% by weight, preferably from 20% by weight to 70% by weight, based on the total metal working fluid concentrate. The metal working fluid concentrate is usually converted into a water and oil emulsion by diluting the concentrate with water, preferably in such proportions that the emulsion contains from 1% to 10% by weight of the concentrate.

The base fluid for the metal working fluid may also comprise functional additives, such as metal passivators, like benztriazole, corrosion inhibitors, like phenyl alpha-naphthylamine, anti-oxidants such as those of the phenolic type, biocides, antifoam agents such as silicone polymers, emulsifiers, detergents or dispersing agents, fungicides, bacteriocides, colouring agents and mixtures of any one or more of these functional additives. The invention will now be illustrated by the following examples.

The present invention also relates to novel stoichiometrically neutral alkali metal or alkanol amine salts of the partial ester of a polymerized unsaturated $C_{12}$-$C_{24}$ fatty acid, selected from the group consisting of dimer acid, trimer acid, hydrogenated dimer acid, hydrogenated trimer acid, and mixtures thereof, and a monohydric alkoxylated alcohol selected from the group consisting of: (a) straight or branched chain, saturated monohydric alcohols having from 1 to 24 carbon atoms which are alkoxylated with from 2 to 25 moles of a $C_2$-$C_5$ alkylene oxide, and having an average molecular weight of from 200 to 900, (b) alkoxylated polyalkylene glycols in which one of the two terminal hydroxyl groups is etherified with a $C_1$-$C_4$ aliphatic monohydric alcohol and which is alkoxylated with from 2 to 25 moles of a $C_2$-$C_5$ alkylene oxide and having an average molecular weight of from 200 to 900, and mixtures of (a) and (b) and, optionally, (c) an aliphatic straight or branched chain, saturated or unsaturated, monohydric alcohol having from 1 to 24 carbon atoms, said partial ester having an acid number of from 10 to 120.

Preferably the alcohol is alkoxylated with from 6 to 12 moles of a $C_2$-$C_3$ alkylene oxide and preferably the acid number is from 20 to 100. Preferably the non-alkoxylated monohydric alcohol has from 3 to 14 carbon atoms.

The invention will now be illustrated by the following examples.

EXAMPLE I

A 2 liter four-necked reaction vessel, equipped with a mechanical stirrer, thermometer, a water cooler and an inlet for inert gas was charged with 564.9 grams (1.61 moles) of Breox methoxypolyethylene glycol 350 (a methoxy polyethylene glycol (Trade Mark, ex B. P. Chemicals, UK; having an average molecular weight of 335–365; a density of 1.09 g.cm$^{-3}$; a freezing point of 5° C. and a viscosity of at 100° C. of 4.1 mm$^2$/sec) and 935.1 grams (1.06 moles) of trimer acid (PRIPOL 1040, Trade Mark, ex Unichema Chemie BV, Gouda, The Netherlands, having an acid value of 184–194, a saponification value of 195–205 comprising 75 wt % of trimer acid and 25 wt % of dimer acid). The mixture was heated to 250° C. under a constant nitrogen flow and the reaction water was distilled off. After the acid value had fallen below 70, the reaction was proceeded at 250° C. and reduced pressure (approximately 1000 Pa) for 1 hour. The obtained partial ester was a brown viscous oil having an acid number of 65. 200 grams of this product were neutralized with 14.2 grams of monoethanol amine.

EXAMPLES II–IV

The same partial ester of Example I was neutralized as follows:

200 grams of the partial ester was neutralized with

II. 34.6 grams of triethanolamine

III. 44.3 grams of tri-isopropanolamine

IV. 26.0 grams of 50% by weight aqueous potassium hydroxide solution

EXAMPLE V

A 2 liter four-necked reaction vessel equipped with a mechanical stirrer, a thermometer, a water cooler and an inlet for inert gas was charged with 425.0 grams (1.21 moles) of Breox methoxypolyethylene glycol 350 (as in Example I) and 1075.0 grams (1.82 moles) of dimer acid (PRIPOL 1022, Trade Mark, ex Unichema Chemie B. V., Gouda, The Netherlands, having an acid value of 192–196 a saponification value of 197–202, comprising 72–80 wt % of dimer and 20–23 wt % of trimer acid). The reaction mixture was heated to 250° C. for 4 hours under a constant nitrogen flow and the reaction water was distilled off. The raw product was light brown oil with an acid value of 96. 200 grams of this product were neutralized with 51.1 grams of triethanolamine.

EXAMPLE VI

A 2 liter four-necked reaction vessel equipped with a thermometer, a water cooler, mechanical stirrer and a combined inlet tube for inert gas and isopropanol connected with a mechanical pump and 2.5 liter flask filled with isopropanol, was charged with 979.6 grams (1.66 moles) of dimer acid (PRIPOL 1022, as in Example V) and 387.4 grams (1.11 moles) Breox methoxypolyethylene glycol 350 (as in Example I). The reaction mixture was heated to 250° C. under a constant nitrogen flow and reaction water was removed by distillation. After approximately 3 hours the acid value had reached a value of 100 and hardly no reaction water was distilled off anymore.

The reaction mixture was then cooled to 230° C. and 1.5 grams (0.011 moles) of tin(II)oxide as catalyst was added to the reaction mixture. Then the introduction of isopropanol was started. The reaction was proceeded under a constant introduction of isopropanol and a nitrogen flow at 230° C. and reaction water and unreacted isopropanol were distilled off. After 6 hours the isopropanol introduction reaction was stopped and the reaction mixture was cooled. The crude reaction product was a brown liquid with an acid value of 38. 200 grams of this product were neutralized with 20.2 grams of triethanolamine.

EXAMPLE VII

A 2 liter four-necked reaction vessel equipped with a mechanical stirrer, a thermometer, a Dean-Stark trap with a vertically arranged water cooler and an inlet for inert gas was charged with 209.4 grams (0.60 moles) of Breox methoxy polyethylene glycol 350 (ex B. P. Chemicals, as in Example I) and 956.3 grams (1.03 moles) of trimer acid (PRIPOL 1240, Trade Mark, ex Unichema Chemie BV, The Netherlands having an acid value of 180–190, comprising 90 wt % of trimer acid and 10% of dimer acid).

The reaction mixture was heated to 250° C. for 4 hours under a constant nitrogen flow and the reaction water was distilled off. After the acid value had fallen below 135, the reaction was proceeded at 250° C. and reduced pressure (approximately 1000 Pa) for 1 hour. After cooling to 80° C. 334.3 grams (2.57 moles) of 2-ethylhexanol was added to the reaction vessel. The reaction mixture was heated again to 250° C. under a constant nitrogen flow. The condensed reaction water was collected in the Dean-Stark trap and the 2-ethylhexanol was continuously refluxed. After 3 hours the unreacted 2-ethylhexanol was distilled off under reduced pressure (approximately 1000 Pa) and 250° C.

The raw product was a dark brown viscous oil with an acid value of 20. 200 grams of this product were neutralized with 10.6 grams of triethanolamine.

EXAMPLES VIII–XIII

Base fluids were made by mixing 40 grams each of the products as prepared in Examples I–IX with 5 grams of isononanoic acid (Cekanoic C9 acid, Trade Mark, ex Exxon Chemicals), 2.5 grams of tall oil fatty acids (ex A. Smit & Sons BV), 2.5 grams of glycerol mono-oleate (PRIOLUBE 1407, Trade Mark, ex Unichema Chemie BV, Gouda, The Netherlands, having a saponification value of 165+175, an iodine value of 74–83 and a max. cloud point of 10° C.), 5 grams of boric acid, 7.5 grams of monoethanolamine, 0.25 grams of Foam-Ban MS 455 (Trade Mark, ex Ultra Additives Inc. USA) and 37.25 grams of water.

The concentrates obtained were diluted at a 5% by weight level in water to make transparent emulsions, which were tested with the Falex lubricant tester. The wear properties of the emulsions were measured according to ASTM specification No. 2670 and the extreme pressure properties were measured according to ASTM specification no. 3233 (Method A).

Some modifications had been made to the Falex lubricant tester, however, in that the standard sample cup was replaced by a larger sample vessel, so that the total volume to be tested was 1200 ml of emulsion, which contained 60 grams of concentrate. Also a cooling device was placed in the sample vessel.

After the wear measurements, the surface roughness ($R_a$) of the test pins was determined by a Taylor Hobson surface analyzer.

The results were as follows:

| | | ASTM 2670 (load 1000 lbs) | | ASTM 3233 |
|---|---|---|---|---|
| Example No. | Product of examples | no. of teeth wear | $R_a$ in μm | Failure level in lbs |
| VIII | I | 35 | 4.0 | 2600 |
| IX | II | 36 | 6.1 | 2550 |
| X | III | 26 | 5.2 | 2350 |
| XI | V | 17 | 1.3 | 2600 |
| XII | VI | 30 | 2.7 | 2550 |
| XIII | VII | 13 | 0.8 | 2500 |
| Reference *) | 20 | 3.2 | 2450 | |

*) The reference sample was a commercially available metal working fluid based on a paraffinic oil It should be realized that the reference sample did contain effective amounts of anti-wear additives and extreme pressure additives. This explains why the wear characteristics of the Examples VIII, IX and X were less good than that of the reference sample. The failure load of all examples according to the present invention is more positive, however, and even in case of Example X the failure load in the presence of anti-wear and/or extreme pressure additives will be far better.

We claim:

1. A base fluid for metal working fluids comprising a stoichiometrically neutral salt of the esterification product, obtained by partial esterification of:
   (a) polymerized unsaturated $C_{12}$-$C_{24}$ fatty acid, selected from the group consisting of dimer acid, trimer acid, hydrogenated dimer acid, hydrogenated trimer acid, and mixtures thereof,
   (b) a monohydric alkoxylated alcohol selected from the group consisting of:
      (1) straight or branched chain, saturated monohydric alcohols having from 1 to 24 carbon atoms, which are alkoxylated with from 2 to 25 moles of a $C_2$-$C_5$ alkylene oxide, and
      (2) alkoxy polyalkylene glycols in which one of the two terminal hydroxyl groups is etherified with a $C_1$-$C_4$ aliphatic monohydric alcohol and which is alkoxylated with from 2 to 25 moles of a $C_2$-$C_5$ alkylene oxide, and mixtures of (1) and (2), and optionally,
   (c) an aliphatic, straight or branched chain, saturated or unsaturated monohydric alcohol, having from 1 to 24 carbon atoms, until a partial ester is obtained, having an acid number of from 10 to 120, after which said partial ester is:
   (d) converted into a stoichiometrically neutral salt by means of a neutralizing agent, selected from the group consisting of ammonium hydroxide, the alkali metal hydroxides, the alkyl amines, the alkanol amines, and mixtures thereof.

2. A base fluid according to claim 1, in which (a) is trimer acid.

3. A base fluid according to claim 1, in which (a) is a mixture of dimer acid and trimer acid.

4. A base fluid according to claim 1, in which the alcohol (b) comprises from 6 to 12 moles of a $C_2$-$C_5$ alkylene oxide.

5. A base fluid according to claim 1, in which the alcohol (b) has an average molecular weight of from 200 to 900.

6. A base fluid according to claim 1, in which the alcohol (c) has from 3 to 14 carbon atoms.

7. A base fluid according to claim 1, in which the partial ester has an acid number of from 20 to 100.

8. A base fluid according to claim 1, in which the neutralizing agent in step (d) is a primary, secondary or tertiary alkyl amine, having an alkyl group of from 2 to 8 carbon atoms.

9. A base fluid according to claim 1, in which the neutralizing agent in step (d) is a mono-, di- or tri-alkanolamine having an alkanol group of from 2 to 8 carbon atoms.

10. A metal working fluid concentrate comprising from 1% to 95% by weight of the base fluid according to claims 1–9.

11. A metal working fluid concentrate comprising from 20% to 70% by weight of the base fluid according to claims 1–9.

12. A stoichiometrically neutral alkali metal or alkanol amine salt of a partial ester of
   (a) polymerized unsaturated $C_{12}$-$C_{24}$ fatty acid, selected from the group consisting of dimer acid, trimer acid, hydrogenated dimer acid, hydrogenated trimer acid, and mixtures thereof, and (b) a monohydric alkoxylated alcohol selected from the group consisting of:

(1) straight or branched chain, saturated monohydric alcohols having from 1 to 24 carbon atoms which are alkoxylated with from 2 to 25 moles of a $C_2$-$C_5$ alkylene oxide and having an average molecular weight of from 200 to 900, (2) alkoxy polyalkylene glycols in which one of the two terminal hydroxyl groups is etherified with a $C_1$-$C_4$ aliphatic monohydric alcohol and which is alkoxylated with from 2 to 25 moles of a $C_2$-$C_5$ alkylene oxide and having an average molecular weight of from 200 to 900 and mixtures and mixtures of (1) and (2), and optionally (c) an aliphatic, straight or branched chain, saturated or unsaturated monohydric alcohol having from 1 to 24 carbon atoms said partial ester having an acid number of from 10 to 120.

13. A salt according to claim 12, in which alcohol (b) is alkoxylated with from 6 to 12 moles of a $C_2$-$C_3$ alkylene oxide.

14. A salt according to claim 12, in which alcohol (c) has from 3 to 14 carbon atoms.

15. A salt according to claim 12, in which the partial ester has an acid number of from 20 to 100.

16. In a metal working fluid in the form of an oil and water emulsion of a base fluid, the improvement wherein the base fluid is the base fluid of claim 1.

17. A base fluid according to claim 1 wherein the partial esterification is obtained with a mixture of (1) and (2).

* * * * *